United States Patent [19]

Willmore

[11] 4,286,525

[45] Sep. 1, 1981

[54] OVER-THE-BED-TABLE

[76] Inventor: Kathryn A. Willmore, 6509 Navaho Trail, Edina, Minn. 55424

[21] Appl. No.: 122,754

[22] Filed: Feb. 19, 1980

[51] Int. Cl.[3] ..... A47B 23/00; A47B 1/00

[52] U.S. Cl. ..... 108/93; 5/507; 108/49; 108/102; 108/143

[58] Field of Search ..... 108/93, 102, 137, 143, 108/5, 49; 5/507; 211/135, 153

[56] References Cited

U.S. PATENT DOCUMENTS

| | | | |
|---|---|---|---|
| 7,789 | 11/1850 | Shoenberger | 108/93 |
| 883,325 | 3/1908 | MacMillan | 108/49 |
| 1,063,642 | 6/1913 | Birdsall | 108/93 X |
| 1,257,843 | 2/1918 | Gonyea | 108/93 |
| 1,484,476 | 2/1924 | Currie | 211/153 X |
| 2,652,300 | 9/1953 | Graber et al. | 108/93 |
| 2,692,806 | 10/1954 | Grace | 108/93 X |
| 2,696,246 | 12/1954 | Putnam | 108/93 |
| 2,849,123 | 8/1958 | Magill | 211/153 X |
| 3,334,954 | 8/1967 | Kesling | 211/153 X |
| 3,680,158 | 8/1972 | Speed | 108/49 |
| 3,998,170 | 12/1976 | Gordon | 211/153 X |
| 4,036,369 | 7/1977 | Eisenberg | 108/102 |

FOREIGN PATENT DOCUMENTS

| | | | |
|---|---|---|---|
| 87251 | 9/1936 | Sweden | 5/507 |

*Primary Examiner*—James T. McCall
*Attorney, Agent, or Firm*—Wicks & Nemer

[57] ABSTRACT

An over-the-bed table including a central top portion having a first end portion slidably mounted on one end thereof and a second end portion slidably mounted on the other end thereof. A first U-shaped leg member is pivotally mounted on the outer end of the first top end portion, and a second U-shaped leg member is pivotally mounted on the outer end of the second top end portion. The length of the leg members is such that the same support the top portions above and spaced from the uppermost surface of a bed over which the top is placed with the legs extending downwardly alongside the bed. The length of the top is adjustable to a length greater than the width of the bed.

With the table free of a bed the legs may be pivoted to a position under the top members for compact storage.

1 Claim, 5 Drawing Figures

OVER-THE-BED-TABLE

SUMMARY

The invention relates broadly to tables and more particularly to a table with which the top thereof may be positioned above and spaced from the upper surface of a bed. Known tables for use with beds include tables placed on top of beds with the problem of positioning and stabilizing the table on the bed, and tables having a top that is swingable over a bed from a single pedestal at one side of a bed which presents problems of balance and the table supporting pedestal extending under the bed.

It is therefore an object of the invention to provide a table for use with a bed that overcomes the aforementioned objections and it includes a table top extendable to a length to extend beyond the width of the bed on both sides with the top supported by legs at each end of a length to contact a floor and support the table top above and spaced from the top surface of a bed. The table top is adjustable so as to accommodate beds of different widths, and the legs are pivotally mounted for placement under the table top for compact storage. The table may also be used for over a chair with the top of the table extended above and spaced from the seat and/or arms of the chair.

The invention will appear more clearly from the following detailed description when taken in connection with the accompanying drawings, showing by way of example a preferred embodiment of the invention idea wherein like numerals refer to like parts throughout.

In the drawings forming part of this application:

FIG. 1 is the side elevational view of an over-the-bed-table embodying the invention in position over a bed shown in broken lines.

Figures 2, 3, 4, 5, 7:
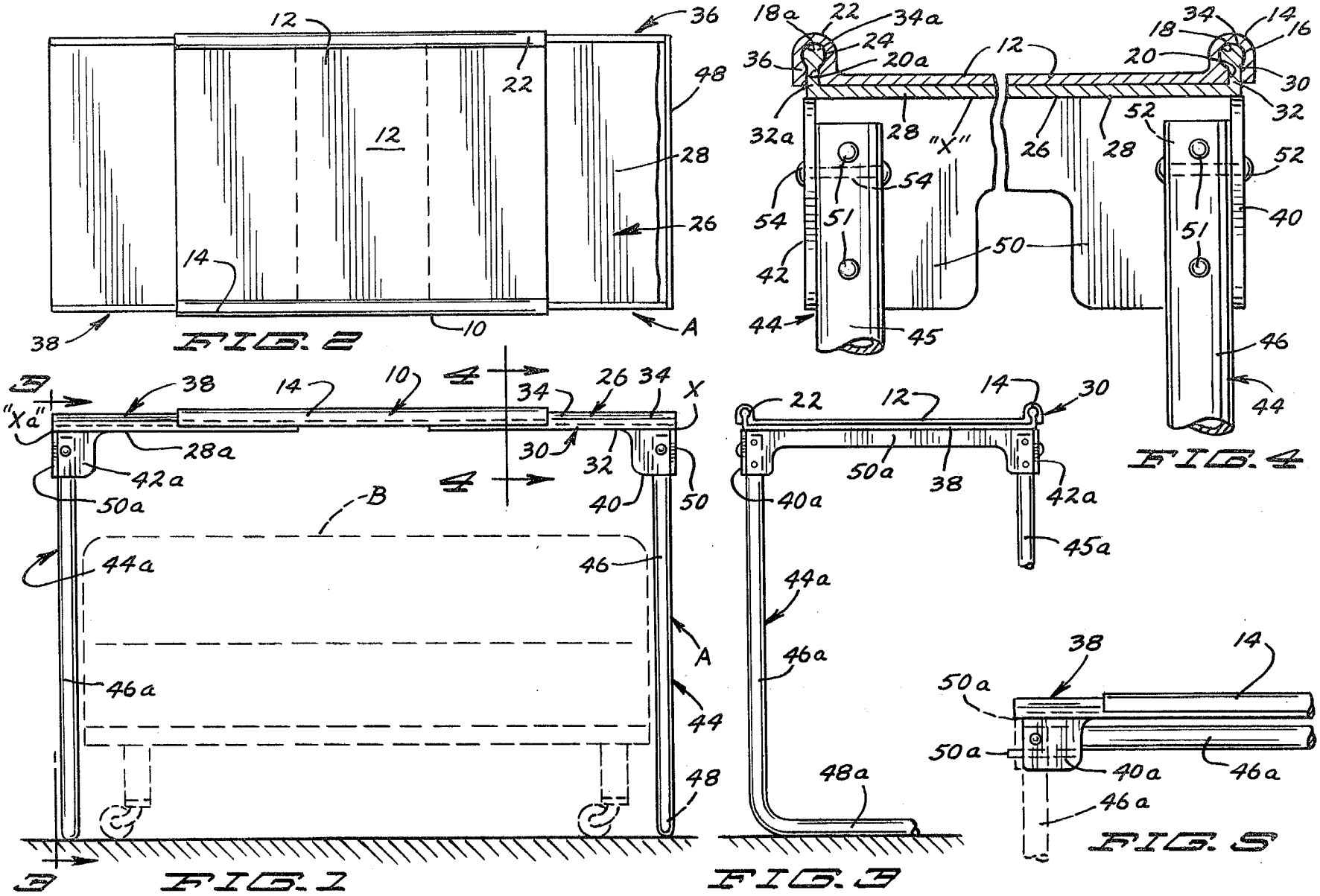
FIG. 2 is a top plan view thereof in an extended condition.
FIG. 3 is an end view thereof with a portion broken away.
FIG. 4 is a sectional view on the line 4—4 of FIG. 1.
FIG. 5 is a side elevational view of an upper corner portion of the table with the top center portion in retracted position and a leg member in collapsed storage position under the table top.

Referring to the drawings in detail, the over-the-bed table A includes the top 10. The top 10 includes the central flat substantially rectangular portion 12 which has a first upstanding rib 14 formed on one longitudinal edge thereof. The rib 14 has formed internally thereof and extending throughout its length the slot 16 which includes the partial hollow cylindrical portion 18 and which terminates in a parallel walled slot portion 20 having a width less than a diameter of the slot portion 18.

Formed on the opposite longitudinal edge of the central top portion 12 is a second upstanding rib 22 parallely disposed to the first rib 14. The rib 22 has formed therein a slot 24 identical to the slot 16 hereinbefore described, identical parts bearing identical numerals accompanied by a lower case letter a included.

The numeral 26 designates a first top end portion which includes the flat substantially rectangular body 28. Formed along one longitudinal edge of the top end portion 26 is a first upstanding rib 30 which includes the upstanding wall portion 32 which terminates in the outer semi-cylindrical portion 34 a diameter of which is greater than the width of the wall portion 32. The rib 30 is adapted to slide easily within the slot 16.

The first top end portion 26 also includes the second upstanding rib 36 formed on the other longitudinally extending edge of the top which is identical to the rib 30, identical parts bearing identical numerals accompanied by a lower case letter a included. The rib 36 slides easily in the slot 24 of the top portion 12.

Further provided is a second top end portion 38 which is identical to the first top end portion 26 with like parts having identical numerals but with a lower case letter a included and which slides in the ribs 14 and 22 of the top portion 10 as in the case of the first top end portion 26.

The first top end portion 26 also includes the flat short depending first side end apron portion 40 extending from the wall portion 32. A second end apron 42 depends from the first top end portion 26 and extends from the wall portion **32*a*. The second top end portion 38** has first and second end apron portions identical to those of the first top end with identical portions having identical reference numerals accompanied by a lower case letter a.

The numeral 44 designates a first U-shaped leg member which includes the side members 45 and 46 joined at the bottom ends by a cross member 48. The upper ends of the side leg members 45 and 46 are connected by the flat cross member 50 by means of the bolts 51. The upper end of the leg 46 is pivotally connected to the side end apron 40 by means of the pivot pin 52 and the upper end of the leg 44 is pivotally connected to the side end apron 42 by means of the pivot pin 54 whereby the leg member 44 can be pivotally moved to a storage position under the top end and central top portion in the manner illustrated in FIG. 5. With the leg member 44 in the downward position the upper edge of the flat cross member 50 is in abutting contact with the under surface of the top end portion 26 as at X and also as shown in broken lines in FIG. 5 which positions leg 44 normal to top portion 26. Similarly the top edge of flat cross member **50*a* abuts the under surface of end portion 38 as at "Xa" whereby the leg member 44*a* is positioned normal to said end member 38. Additionally the leg members are of a length whereby the top 10** is supported above and spaced from the uppermost surface of the bed B with the top portions adjustably positioned so that the length of the table exceeds the width of a bed such as B.

Having thus described the invention, what is claimed as new and desired to be secured by Letters Patent is:

1. An Over-The-Bed table comprising:

(a) a top including a central portion, (b) a first end portion, and (c) a second and oppositely disposed end portion, (d) means slidably mounting said first end portion on said central portion including an upstanding rib formed along each edge of said first end portion and slideably positioned in (e) a slot formed in the underside of an upstanding rib formed along each edge of said central portion, (f) means slideably mounting said second end portion on said central portion including an upstanding rib formed along each edge of said second end portion and slideably positioned in said slots of said upstanding ribs of said central portion, (g) first leg means, (h) second leg means, (i) means hingedly mounting said second leg means on said second end portion for extension of said leg means to from said top to a position on a supporting surface for supporting said top above the top surface of a bed, (j) each of said first and second leg means having a length sufficient to support said top portions extended above the top surface of a bed positioned between said first and second leg means and under said top portions.

* * * * *